United States Patent [19]

Inadama

[11] 4,002,196

[45] Jan. 11, 1977

[54] METHOD FOR FORMING AN EQUALIZED LAYER TO A SHAPING SURFACE OF A MOLD

[76] Inventor: Katsutoshi Inadama, 537 Oaza-Sakurado, Koshoku, Japan, 387

[22] Filed: Jan. 11, 1974

[21] Appl. No.: 432,654

[52] U.S. Cl. ..... 164/7; 164/65

[51] Int. Cl.[2] ..... B22C 9/02

[58] Field of Search ..... 164/7, 72, 160, 61, 164/65, 255, 361, 41

[56] References Cited

UNITED STATES PATENTS

| | | | |
|---|---|---|---|
| 2,434,780 | 1/1948 | Wiss et al. | 164/61 |
| 3,086,874 | 4/1963 | Wallace et al. | 164/41 X |
| 3,400,751 | 9/1968 | Behnke | 164/7 |
| 3,692,550 | 9/1972 | Melcher et al. | 164/72 X |
| 3,789,907 | 2/1974 | Nakata et al. | 164/7 |

FOREIGN PATENTS OR APPLICATIONS

| | | | |
|---|---|---|---|
| 532,539 | 11/1956 | Canada | 164/72 |
| 1,106,514 | 7/1955 | France | 164/160 |

*Primary Examiner*—Robert D. Baldwin
*Attorney, Agent, or Firm*—Holman & Stern

[57] ABSTRACT

This invention relates to a method for molding and forming an equalized layer onto a shaping surface of a mold, and also relates to a method for forming the layer onto the shaping surface of the mold which has a hardened layer on the shaping surface of the mold.

6 Claims, 4 Drawing Figures

METHOD FOR FORMING AN EQUALIZED LAYER TO A SHAPING SURFACE OF A MOLD

BACKGROUND OF THE INVENTION

Proposals have been made as to various types of molding methods wherein filling materials consisting of heat resisting particulate materials are maintained by negative pressure, thereby forming cavities.

In conventional methods, a mold is formed by binding or hardening the whole mold, using a sand which includes a binder. As the filling material experience has shown that there has been a falling-down or slacking-down of the filling material of the mold into the cavity, in case of insufficiency of the binder, or shock by handling. Sometimes the shaping surface of the mold is washed away by the running of the molten metal.

SUMMARY OF THE INVENTION

According to the present invention, a filling material consisting of a heat resisting particulate material is formed to have a shaping surface by a pattern member; a sealing layer, which is formed to the shape of the shaping surface, is made by a sealing material such as facing material or resinous material, applied to the shaping surface of the filling material; the filling material is kept under negative pressure, thereby drawing the sealing layer to the filling material; a cavity is formed by the shaping surface of the filling material; and then a molten metal is poured into the cavity.

Further, in accordance with this invention, there is described a method for forming an equalized layer onto the shaping surface of the mold in which a substance binding or hardening a filling material is applied and permeated to the shaping surface of the mold, thereby forming a bound layer or a hardened layer.

The present invention has as its object to provide a method for forming an equalized layer onto the shaping surface which provides improvements in conventional methods, and obviates the aforementioned disadvantages.

One of the objects of the invention is to provide a method for forming an equalized layer onto the shaping surface in order to make an easy molding operation which avoids any difficulty in the condition of the shape.

Another object of the invention is to provide a method for forming an equalized layer onto the shaping surface wherein a filling material, maintained under negative pressure, includes a heat resisting particulate material with a low percentage of water or moisture in order to prevent falling of the mold from falling or slacking of the filling material.

A further object of the invention is to provide a method for forming an equalized layer onto the shaping surface with a sealing layer being formed with a substance for binding or hardening the filling material near the surface of the mold.

A still further object of the invention is to form the layer onto a surface of the mold containing a very weak binder, such as 2–4% water or the lowest percentage of the known binder, so that the mold can be put up with a pattern release.

BRIEF DESCRIPTION OF THE DRAWINGS

Other and additional objects, as well as features and advantages, of the present invention will become evident from the description set forth hereinafter with reference to the drawings, wherein.

DETAILED DESCRIPTION OF THE INVENTION

The present invention has application for conventional molds to form a layer as a molds facing, and also for so-called V-Process to form a shielding mold member.

Now therefor, one embodiment for V-Process of the invention will be described with reference to FIG. 1–FIG. 4.

Figure 1:
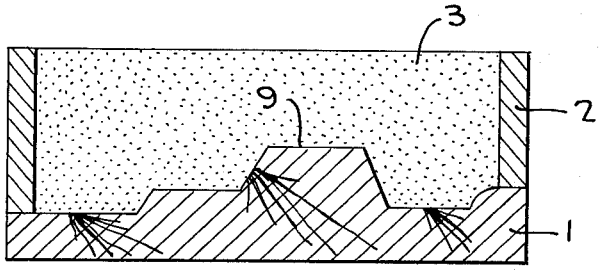
FIG. 1 is a sectional view of the condition in which a flask is set on a pattern member, and the flask is filled with a filling material.

In FIG. 1, a flask 2 is placed on a pattern member 1 made of wood and the like having a surface 9, and the flask is filled with a filling material 3 consisting of a heat resisting particulate material which has a proper water or moisture content. At this moment, the filling density of the filling material is increased by applying vibrations, and at the same time a shaping surface 9 is formed in the filling material 3 by the surface of the pattern member 1, the filling material 3 is solidified by the low percentage of water contained in it.

Figure 2:
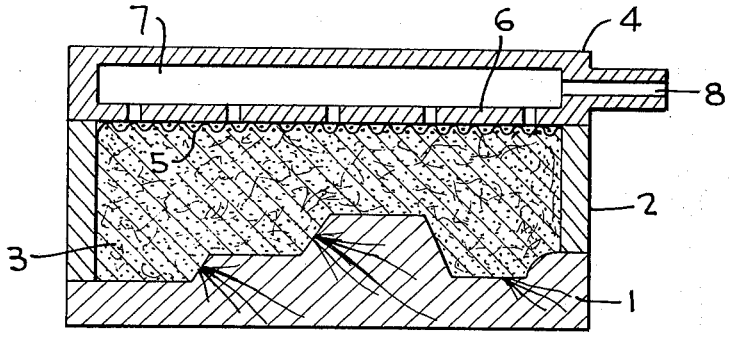
FIG. 2 is a sectional view of the condition in which an evacuation box is placed on the flask shown in FIG. 1.

In FIG. 2, an evacuation box 4 is set on the flask 2, and the evacuation box 4 is, on the side coming in contact with the flask 2, provided with an air-permeable wall 6 covered with a filter 5. The air-permeable wall 6 communicates with a chamber 7. The evacuation box 4 has a connection opening 8 on one side which communicates with an evacuation means (not shown).

Figure 3:
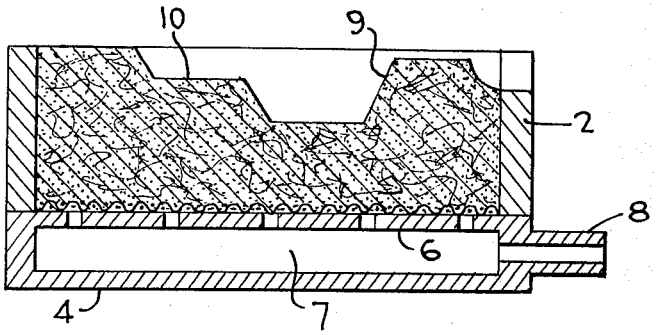
FIG. 3 is a sectional view of the condition in which the flask shown in FIG. 2 is turned over, the pattern member is released from the flask, and a bound layer, or a hardened layer, is formed onto the shaping surface of a mold, drawing air through the evacuation box.

Then in FIG. 3, the flask 2 is turned over, and the pattern member 1 is released from the flask. At this moment, since the filling material 3 contains water, moisture or a binder, the mold itself can be certainly maintained.

In this case, a sealing material 10, consisting of a paint with instant drying properties is applied to the shaping surface 9 formed on the filling material 3, and a portion of the shaping surface 9 is made impermeable filling the space between each particle of the filling material 3 in the portion of the shaping surface 9, and therefor a sealing layer is formed onto the shaping surface 9 made on the filling material 3.

The inside of the flask 2 is evacuated from the evacuation opening 8 through the air-permeable wall 6 and the chamber 7, so that the inside of the flask 2 is kept under negative pressure. Accordingly, water or moisture contained in the filling material 3 is rapidly removed. Thereby the sealing material 10 is drawn to the air-permeable wall 6 by the negative pressure inside the flask 2. In this stage, since the filling material 3 in the flask 2 is pressed, through the sealing material 10, by the atmospheric pressure, the relative movement between each particle of the filling material 3 is prevented, and therefor the original shape set in the filling material 3 is maintained.

Figure 4:
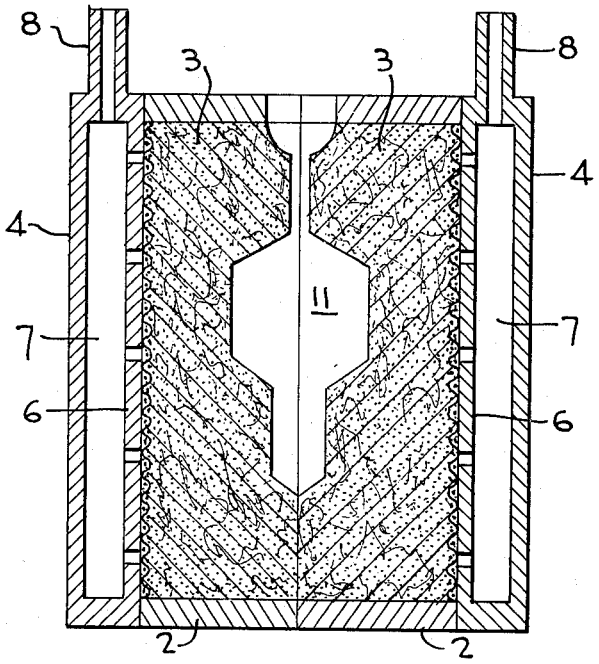
FIG. 4 is a sectional view of the mold assembly obtained from the process of FIG. 1 – FIG. 3.

Now, a cavity 11 is formed, as shown in FIG. 4, with the molds having the sealing layer 10 bound or hardened to the shaping surfaces 9 of the filling material 3, and a molten metal is poured into the cavity 11, producing molded products such as cast iron, cast steel, stainless steel, aluminum or other metals and alloys.

According to these arrangements, since the sealing material is applied to form the sealing layer, it is certainly possible to form the sealing layer 10 easily and rapidly by applying and spraying the sealing material 10 onto the shaping surface 9 of the filling material 3, thereby making the molding operation easy and trouble-free for application to a variety of shapes.

Furthermore, it is possible to form the shaping surface of the filling material by the use of a filling material having some moisture.

What is claimed is:

1. A method for molding metal comprising the steps of:

forming an equalized layer onto a shaping surface of each of two complementary molds comprising the steps of: placing a mold flask on a pattern member having a surface of the same shape as a casting; filling the flask with a filling material consisting of a heat resisting particulate material having a volatile binder, a shaping surface defining a cavity being formed in the filling material by the pattern member; setting an evacuation box on top of the flask; inverting the pattern member, the flask and the evacuation box; removing the pattern member from the flask; forming a sealing layer by applying a sealing material having instant drying properties onto the shaping surface; evacuating the flask through the evacuation box to remove the volatile binder from the filling material and to draw the dryed sealing material to the filling material to prevent movement between the particles of filling material;

joining the two complementary molds so that the adjoining cavities of the molds form a larger cavity; and pouring a molten metal into the larger cavity.

2. The method as claimed in claim 1 in which the sealing layer binds or hardens a portion of the filling material thereby making the shaping surface of the mold air-impermeable.

3. The method as claimed in claim 2 wherein the sealing layer is formed by spraying the sealing material onto the shaping surface.

4. The method as claimed in claim 2 wherein the sealing layer is formed by painting the sealing material onto the shaping surface.

5. The method as claimed in claim 1 wherein the volatile binder of the filling material consists of water in the amount of 2-4% by weight.

6. The method as claimed in claim 1 comprising the further step of vibrating the filling material to accurately take the shape of the pattern member, the volatile binder assisting in maintaining the shaping surface.

* * * * *